US007484965B2

(12) United States Patent
Chien et al.

(10) Patent No.: US 7,484,965 B2
(45) Date of Patent: Feb. 3, 2009

(54) COAXIAL CONNECTOR

(75) Inventors: Min-Lung Chien, Hsin-Tien (TW); Kai-Ray Cheng, Hsin-Tien (TW); Sheng-Shun Chin, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/062,459

(22) Filed: Apr. 3, 2008

(65) Prior Publication Data

US 2008/0254676 A1 Oct. 16, 2008

(30) Foreign Application Priority Data

Apr. 13, 2007 (TW) ..... 96205943 U

(51) Int. Cl.
*H01R 12/00* (2006.01)

(52) U.S. Cl. ..... 439/63; 439/903

(58) Field of Classification Search ..... 439/63, 439/578, 581, 903
See application file for complete search history.

(56) References Cited

U.S. PATENT DOCUMENTS 6,099,334 A * 8/2000 Togashi ..... 439/188
6,971,913 B1 * 12/2005 Chu ..... 439/582
7,097,480 B2 * 8/2006 Fukuzaki et al. ..... 439/188
7,118,383 B2 * 10/2006 Nagata et al. ..... 439/63
7,198,492 B2 * 4/2007 Shichida et al. ..... 439/63

FOREIGN PATENT DOCUMENTS

TW 08920375 5/2001

* cited by examiner

*Primary Examiner*—Thanh-Tam T Le
(74) *Attorney, Agent, or Firm*—patenttm.us

(57) ABSTRACT

A coaxial connector has a hollow shell, an insulative housing, a contact terminal and a stopper. The hollow shell has at least one engaging hole. The insulative housing is mounted in the hollow shell and has at least one hook protruding through the engaging hole to securely connect the insulative housing to the hollow shell. The contact terminal is mounted in the insulative housing and has a body portion and a soldering portion extending out of the insulative housing. The stopper is mounted on the body portion and engaged with the insulative housing to avoid a disconnection between the contact terminal and the insulative housing.

10 Claims, 3 Drawing Sheets

COAXIAL CONNECTOR

BACKGROUND OF THE INVENTION

1. Field of the Invention

The present invention relates to a miniature connector, and more particularly to a coaxial connector that can be mounted at any position on a circuit board and has internal engaging structures to prevent components constituting the coaxial connector from being separated from each other.

2. Description of Related Art

With reference to FIG. 1, a conventional coaxial connector for mounting on a circuit board is disclosed in the Taiwanese Utility Model Application No. 089203075 and comprises a housing (60), an insulative stopper (70) and a terminal (80).

The housing (60) may be made of metal and has a shell (61), a base (62) and multiple pins (63). The shell (61) is mounted on the base (62) and has a front chamber. The pins (63) extend from the base (62) along a direction opposite to the shell (61).

The insulative stopper (70) is mounted in the housing (60) and has a body (71) and a through hole (72). The through hole (72) is formed through the body (71) and communicates with the front chamber of the housing (60).

The terminal (80) has a contact portion (81) and a stepped portion (82). The contact portion (81) protrudes through the through hole (72) of the insulative stopper (70) and extends into the front chamber of the housing (60). The stepped portion (82) abuts against an edge of the circuit board when the coaxial connector is mounted on the circuit board.

Limited by the stepped portion (82), the coaxial connector only can be mounted around the edges of the circuit board. Furthermore, an external force applying to the coaxial connector may easily cause a separation of the terminal (80) from the insulative stopper (70) or a disconnection of the insulative stopper (70) from the housing (60).

To overcome the shortcomings, the present invention provides a coaxial connector to mitigate or obviate the aforementioned problems.

SUMMARY OF THE INVENTION

The main objective of the invention is to provide a coaxial connector capable of being mounted at any position on a circuit board and having internal engaging structures to prevent components of the coaxial connector from being separated from each other.

A coaxial connector in accordance with the present invention comprises a hollow shell, an insulative housing, a contact terminal and a stopper. The hollow shell has at least one engaging hole. The insulative housing is mounted in the hollow shell and has at least one hook protruding through the engaging hole to securely connect the insulative housing to the hollow shell. The contact terminal is mounted in the insulative housing and has a body portion and a soldering portion extending out of the insulative housing. The stopper is mounted on the body portion and engaged with the insulative housing to avoid a disconnection between the contact terminal and the insulative housing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
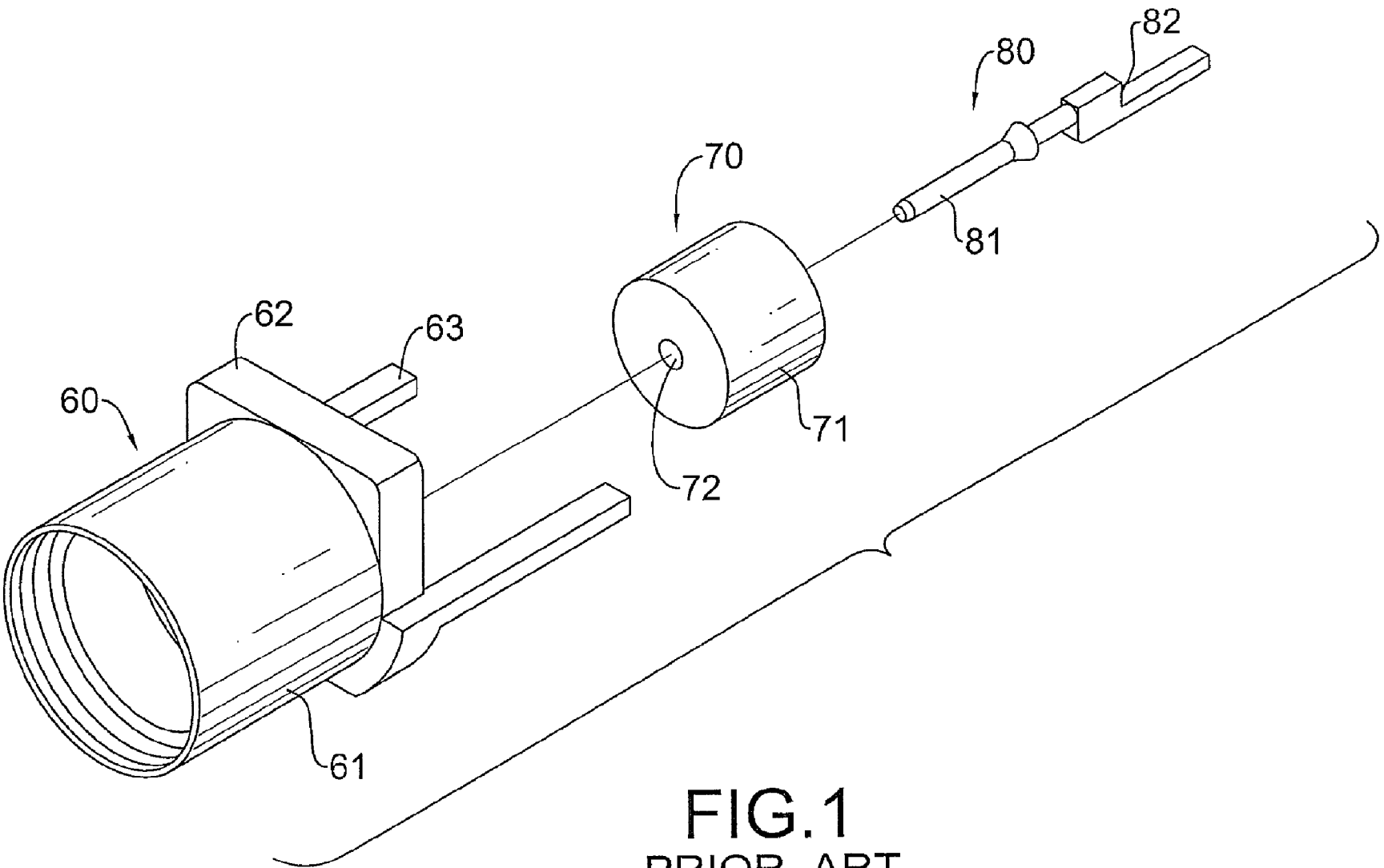
FIG.1 PRIOR ART
FIG. 1 is an exploded perspective view of a conventional coaxial connector in accordance with the prior art.
Figure 2:
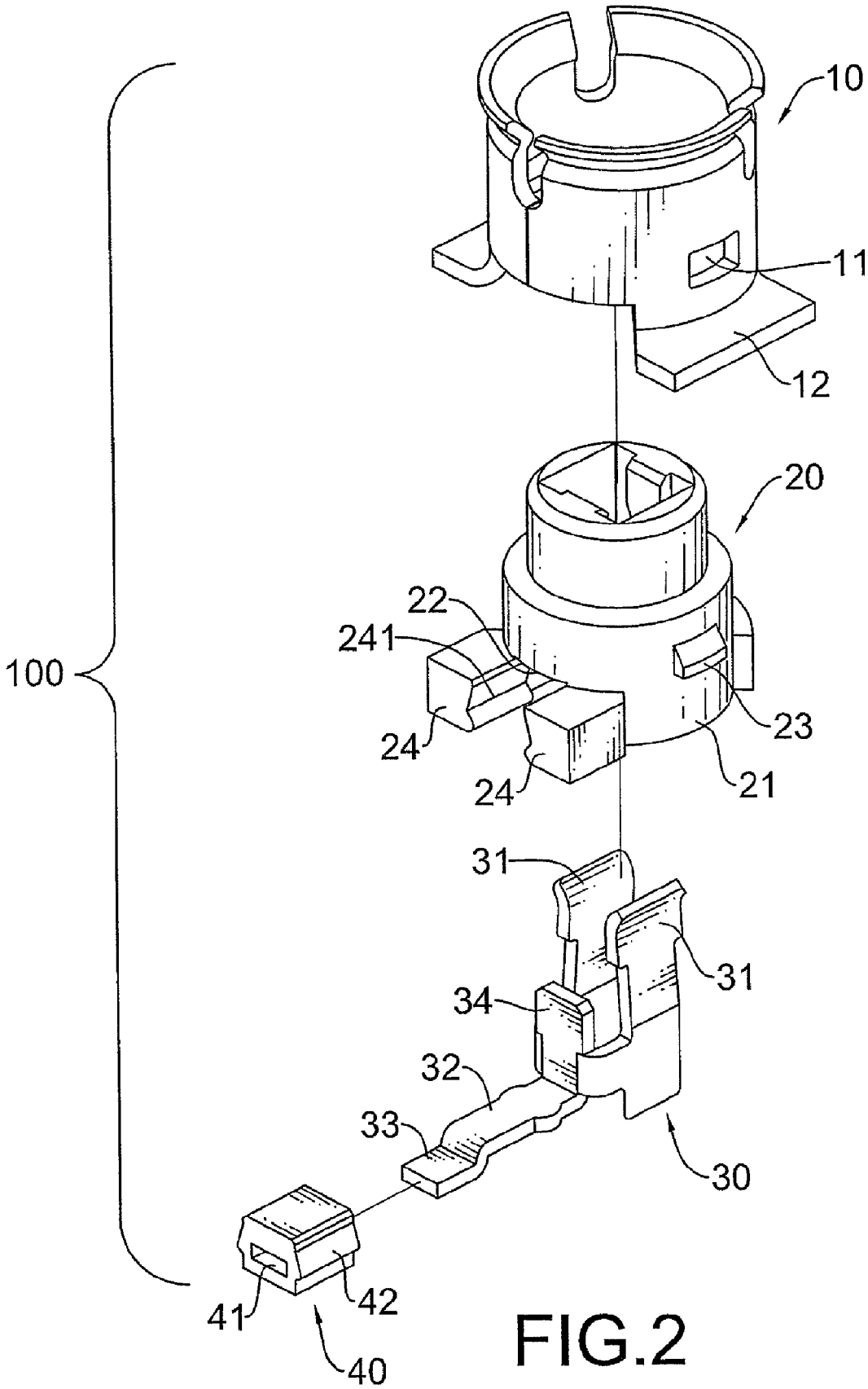
FIG. 2 is an exploded perspective view of a coaxial connector in accordance with the present invention.
Figure 3:
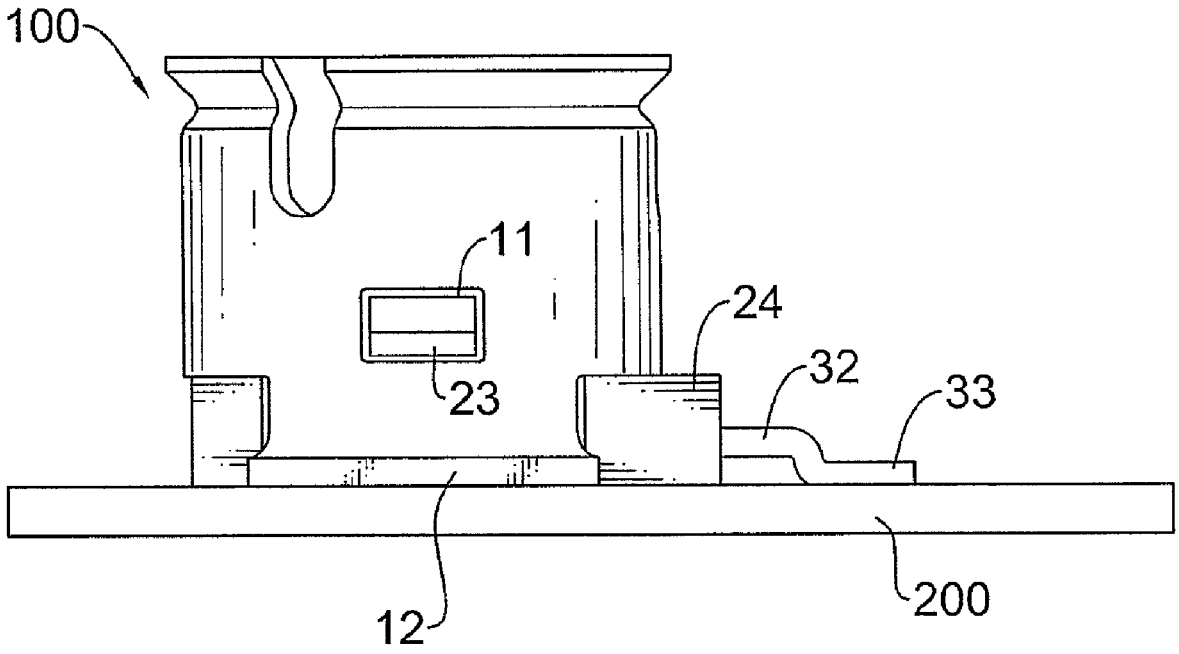
FIG. 3 is an operational side view of the coaxial connector in FIG. 2 mounted on a printed circuit board.

With reference to FIGS. 2 and 3, a coaxial connector (100) in accordance with the present invention is mounted on a printed circuit board (PCB) (200) and comprises a hollow shell (10), an insulative housing (20), a contact terminal (30) and a stopper (40).

The hollow shell (10) may be made of metal and has a bottom, an outer surface and at least one engaging hole (11) and may further have at least one grounding tab (12). The engaging hole (1) is formed through the outer surface of the shell (10). The grounding tab (12) integrally extends from the bottom of the shell (10) and is electrically mounted to the PCB (200) to avoid a disconnection of the coaxial connector (100) from the PCB (200).

The insulative housing (20) accommodates the hollow shell (10) and has a bottom, a top, a space, an outer surface (21), a cut (22) and at least one hook (23) and may further have two engaging blocks (24).

The space with an inner surface is defined through the top and the bottom of the insulative housing (20) and accommodates the contact terminal (30). The cut (22) with opposite edges is formed through the insulative housing (20) near the bottom. The at least one hook (23) is formed on and protrudes from the outer surface (21) and extends through the engaging hole (11) to securely connect the insulative housing (20) to the shell (10). The two engaging blocks (24) perpendicularly form on the outer surface (21) and are respectively adjacent to the opposite edges of the cut (22). Each of the engaging blocks (24) has an lateral surface defined with a groove (241) and protrudes from the hollow shell (10) after the insulative housing (20) is mounted in the shell (10). The two grooves (241) face each other.

The contact terminal (30) may be made of metal, is mounted in the space of the insulative housing (20) and has a body portion (32) with two ends, multiple contact portions (31) and a soldering portion (33) and may further have an extension portion (34).

Preferably, the contact terminal (30) has two contact portions (31) perpendicularly extending and protruding upward from one end of the body portion (32). The two contact portions (31) may be symmetrical and facing each other, or commonly form a substantially circular arrangement.

The body portion (32) protrudes from the insulative housing (20) through the cut (22) between the two engaging blocks (24) when the contact terminal (30) is mounted in the insulative housing (20).

The soldering portion (33) protrudes integrally and longitudinally from the other end of the body portion (32) and is electrically connected on the PCB (200).

In another embodiment, the extension portion (34) is formed perpendicularly to the body portion (31) and connected between the two contact portions (31) to abut against the inner surface of the insulative housing (20).

The stopper (40) may be formed by insert molding and is mounted on the body portion (32) of the contact terminal (30) and engages with the insulative housing (20). The stopper (40) has two opposite sides, a passage (41) and two ribs (42). The passage (41) is defined through the stopper (40) and accommodates the body portion (32) of the contact terminal (30). The two ribs (42) are formed respectively on the opposite sides and are respectively engaged in the grooves (241) of the engaging blocks (24).

The coaxial connector (100) utilizes the hook (23) to achieve a secure connection between the insulative housing (20) and the shell (10). The contact terminal (30) is also securely held by the insulative housing (20) with the stopper (40) to avoid a disconnection from the PCB (200). Since the contact terminal (30) may be made of metal with resilient ability, the two contact portions (32) together with the extension portion (31) have abut against the inner surface in the space of the insulative housing (20). Furthermore, since the whole coaxial connector (100) has a relative flat bottom, it can be mounted at any positions on the PCB (200) without location limitations.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A coaxial connector adapted to be mounted on a printed circuit board (PCB), the coaxial connector comprising:

a hollow shell having a bottom, an outer surface and at least one engaging hole formed through the outer surface;

an insulative housing mounted in the hollow shell and having a top; a bottom; an outer surface;

a space defined through the top and the bottom;

a cut having two opposite edges and formed through the insulative housing near the bottom; and at least one hook protruding from the outer surface of the insulative housing to correspond to the at least one engaging hole;

a contact terminal mounted in the space of the insulative housing and having a body portion having two end and protruding from the insulative housing through the cut;

a plurality of contact portions extending from one end of the body portion and held in the space of the insulative housing; and a soldering portion formed on and protruding from the body portion; and a stopper mounted to the body portion of the contact terminal and engaging with the insulative housing.

2. The coaxial connector as claimed in claim 1, wherein the stopper is formed by insert molding.

3. The coaxial connector as claimed in claim 1 being mounted on the PCB by soldering.

4. The coaxial connector as claimed in claim 1, wherein the contact terminal has at least two contact portions.

5. The coaxial connector as claimed in claim 4, wherein the contact portions are symmetrical to each other.

6. The coaxial connector as claimed in claim 4, wherein the contact portions of the contact terminal perpendicularly extend and protrude upward from the end of the body portion.

7. The coaxial connector as claimed in claim 6, wherein the contact terminal further has an extension portion formed perpendicularly to the body portion and connected between the two contact portions.

8. The coaxial connector as claimed in claim 1, wherein the hollow shell further has at least one grounding tab integrally extending from the bottom of the hollow shell and electrically mounted to the PCB.

9. The coaxial connector as claimed in claim 7, wherein the insulative housing further has two engaging blocks perpendicularly formed on the outer surface of the insulative housing and respectively adjacent to the opposite edges of the cut, and each engaging block has an lateral surface defined with a groove.

10. The coaxial connector as claimed in claim 9, wherein the stopper has two opposite sides;

a passage defined through the stopper and accommodating the body portion of the contact terminal; and two ribs respectively formed on the opposite sides and are engaged in the grooves of the engaging blocks.

* * * * *